US010570642B2

(12) United States Patent
Ramsauer et al.

(10) Patent No.: US 10,570,642 B2
(45) Date of Patent: Feb. 25, 2020

(54) LED INDICATOR SUCH AS LED RING FOR A MECHATRONIC LOCK SYSTEM

(71) Applicant: DIRAK Dieter Ramsauer Konstruktionselemente GmbH, Ennepetal (DE)

(72) Inventors: Dieter Ramsauer, Schwelm (DE); Cem Olkay, Witten (DE)

(73) Assignee: DIRAK Dieter Ramsauer Konstruktionselemente GmbH, Ennepetal (DE)

( * ) Notice: Subject to any disclaimer, the term of this patent is extended or adjusted under 35 U.S.C. 154(b) by 219 days.

(21) Appl. No.: 15/513,265

(22) PCT Filed: Aug. 17, 2015

(86) PCT No.: PCT/EP2015/001689
§ 371 (c)(1),
(2) Date: Mar. 22, 2017

(87) PCT Pub. No.: WO2016/045763
PCT Pub. Date: Mar. 31, 2016

(65) Prior Publication Data

US 2017/0306648 A1 Oct. 26, 2017

(30) Foreign Application Priority Data

Sep. 22, 2014 (DE) ..... 20 2014 007 564 U

(51) Int. Cl.
*E05B 17/10* (2006.01)
*E05B 13/10* (2006.01)
*E05B 17/22* (2006.01)

(52) U.S. Cl.
CPC ..... *E05B 17/10* (2013.01); *E05B 13/10* (2013.01); *E05B 17/22* (2013.01)

(58) Field of Classification Search
CPC ..... E05B 17/10; E05B 1/0092; E05B 13/10; E05B 17/22; E05B 17/106; E05B 17/14;
(Continued)

(56) References Cited

U.S. PATENT DOCUMENTS 6,152,590 A * 11/2000 Furst ..... B60Q 1/2665 362/545
6,318,138 B1 * 11/2001 Mathews ..... E05B 47/0012 292/144
(Continued)

FOREIGN PATENT DOCUMENTS

CN 202706673 1/2013
CN 103670000 3/2014
(Continued)

OTHER PUBLICATIONS

International Search Report PCT/EP2015/001689 dated Dec. 21, 2015.
(Continued)

*Primary Examiner* — Nathan Cumar
(74) *Attorney, Agent, or Firm* — Haug Partners LLP

(57) ABSTRACT

An LED ring or light guide for a mechanical or mechatronic closure system that includes an actuating means, such as socket wrench receptacle or swivel handle, which is rotatably supported in a housing or tray. The LED ring or light guide also includes a retaining nut or bearing piece that can be screwed on with the housing or with the tray with the intermediary of a thin wall such as door panel of a sheet-metal cabinet or sheet-metal housing. A light ring surrounds a flange of the housing or of the tray, and a flexible foil is arranged between light ring and thin wall. The flexible foil carries light emitting diodes (LEDs) and relays the light thereof. A closure indicator integrated in the actuating means is achieved in this way.

17 Claims, 12 Drawing Sheets

(58) Field of Classification Search
CPC .... E05B 17/142; E05B 17/145; E05B 17/147; E05B 17/226; E05B 13/108; E05B 39/00; E05B 45/00
USPC ..... 292/194
See application file for complete search history.

(56) References Cited

U.S. PATENT DOCUMENTS

| | | | | |
|---|---|---|---|---|
| 6,371,637 | B1 | 4/2002 | Atchinson et al. | |
| 9,003,706 | B2 * | 4/2015 | Meves | E05B 65/0025 49/246 |
| 2005/0248931 | A1 * | 11/2005 | Alvarez | E05B 17/10 362/100 |
| 2006/0139148 | A1 * | 6/2006 | Faro | G07C 9/00103 340/5.73 |
| 2010/0142215 | A1 * | 6/2010 | Waring | B60Q 1/2657 362/473 |
| 2014/0053678 | A1 * | 2/2014 | Gottschling | E05B 1/0092 74/523 |
| 2017/0306648 | A1 * | 10/2017 | Ramsauer | E05B 1/0092 |

FOREIGN PATENT DOCUMENTS

| | | | | |
|---|---|---|---|---|
| DE | 198 05 771 | | 8/1999 | |
| DE | 20 312 326 | * | 10/2003 | E05B 17/10 |
| DE | 203 12 326 | | 10/2003 | |
| EP | 1 522 459 | * | 4/2005 | B60Q 3/02 |
| EP | 2 050 902 | | 4/2009 | |
| WO | WO 2012/136292 | | 10/2012 | |
| WO | WO-2012136292 | A1 * | 10/2012 | E05B 1/0092 |

OTHER PUBLICATIONS

International Preliminary Report on Patentability for Application No. PCT/EP2015/001689 dated Dec. 22, 2016.
Notification of First office Action for Chinese application No. 201580051161.6 dated Aug. 1, 2018.
Notification of Second office Action for Chinese application No. 201580051161.6 dated Jun. 4, 2019.

* cited by examiner

LED ring for mechatronic swivel lever system

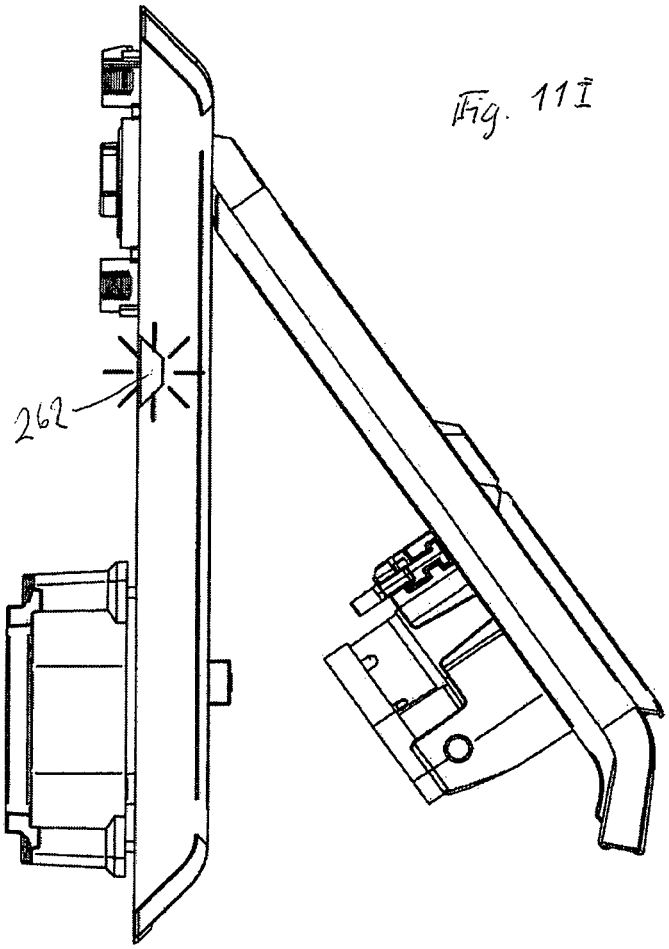
Fig. 11I
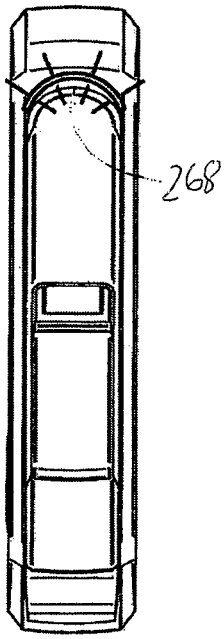
Fig. 13A
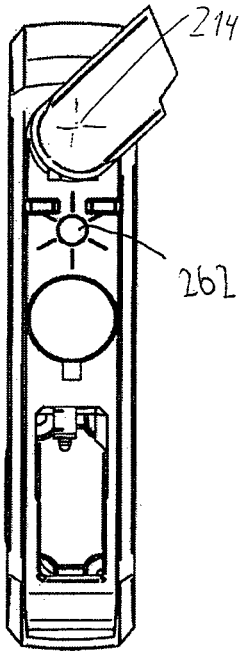
Fig. 13 B
Fig. 12 A
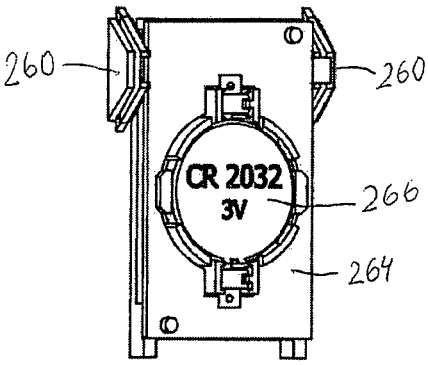
Fig. 12 B
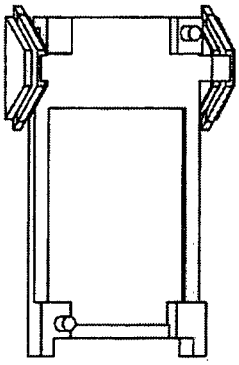

LED INDICATOR SUCH AS LED RING FOR A MECHATRONIC LOCK SYSTEM

The present application claims priority from PCT Patent Application No. PCT/EP2014/001689 filed on Aug. 17, 2015, which claims priority from German Priority Application No. 20 2014 007 564.6 filed on Sep. 22, 2014, the disclosures of which are incorporated herein by reference in their entirety.

FIELD OF THE INVENTION

It is noted that citation or identification of any document in this application is not an admission that such document is available as prior art to the present invention.

The invention is directed to a mechanical or mechatronic closure system comprising an actuating means such as socket wrench receptacle or swivel handle which is swivelably and rotatably supported in a housing or tray and a retaining nut or bearing piece which can be screwed on with the housing or with the tray with the intermediary of a thin wall such as door panel of a sheet-metal cabinet or sheet-metal housing.

Reference is made to documents D1=DE 198 05 771 A1 and D2=US 2010/142215 A1 as prior art.

An LED ring for the operating buttons for elevator installations is known to the present applicant.

SUMMARY OF THE INVENTION

The object of the invention is to provide an LED ring or LED indicator for closure systems of the type mentioned above which is suitable for a sheet-metal cabinet or sheet-metal box and serves as integrated closure indicator.

The above-stated object is met through a light ring surrounding the flange of the housing or tray and with a flexible foil which is arranged between light ring and thin wall and which carries light emitting diodes (LEDs) and relays the light thereof.

According to a further development of the invention, an electronics module or a base plate with printed circuit board is screwed to the tray or to the housing with the intermediary of flexible foil and LEDs.

According to yet another embodiment form of the invention, the electronics module has in integrated heat sink.

According to a further embodiment form of the invention, the base plate supports a contact sensor which cooperates with a sensor adaptor moved by the drive.

According to another embodiment form of the invention, the base plate has a sensor at one longitudinal end for determining the presence of the door frame.

According to yet another embodiment form of the invention, the contact sensor is part of the printed circuit board or part of the electronics module.

According to a further embodiment form of the invention, the sensor has a cable connection to the electronics module or to the printed circuit board for detecting the frame (closed door).

According to yet another embodiment form, the LED ring is made of glass, transparent plastic, optionally with integrated optical waveguides.

According to a further embodiment form of the invention, the LED ring is characterized in that the door sensor for detecting the state of the door is a reed sensor, Hall sensor, reflection-type photo-switch, light barrier, mechanical feeler, pressure sensor, light sensor, proximity sensor (inductive, capacitive, ultrasonic), temperature sensor, rotational angle sensor, and in that the sensor is placed by the customer (existing sensor) on the door frame, hinge.

According to a further embodiment form of the invention, the LED ring is characterized in that a closing sensor for detecting the closing state of the cylinder lock is carried out by a fork light barrier, light barrier, reflection-type photo-switch, mechanical feeler, pressure sensor, potentiometer, proximity sensor (inductive, capacitive, ultrasonic), rotational angle sensor, reed sensor, Hall sensor, with a sensor placement: with extension/adaptor outside of the rotary latch or integrated in the rotary latch.

In an alternative not according to the invention, a light guide is part of the wall of the tray and is made of translucent plastic and is arranged and shaped in such a way that the wall lights up at the desired location during operation of the light emitting diode.

The light guide can be removed as part of the wall and replaced by a part of a different color.

There can be two such parts of the wall which are connected by a carrier plate.

The carrier plate can also form a receptacle for a button cell.

According to another alternative, the light guide can be characterized in that a light emitting diode is arranged in the vicinity of the shaft on the underside of the tray and has light contact with parts of the wall of the tray.

On the other hand, the light guide can also be characterized in that a light emitting diode is arranged in the vicinity of the shaft and has light contact with the wall of the hand lever.

BRIEF DESCRIPTION OF THE DRAWINGS

The invention will be described in more detail in the following with reference to embodiment examples which are shown in the drawings.

FIG. 11I shows a side view of the lever from FIG. 11H in folded-out position.

FIG. 12A shows a perspective view of the removeable light guide with holder for a button cell.

FIG. 12B shows the back of the light guide arrangement.

FIG. 13A shows a top view of a swivel lever closure with light conducted into the free end of the hand lever.

FIG. 13B shows a rear view of the swivel lever closure of FIG. 13A with the position of the light source (LED).

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
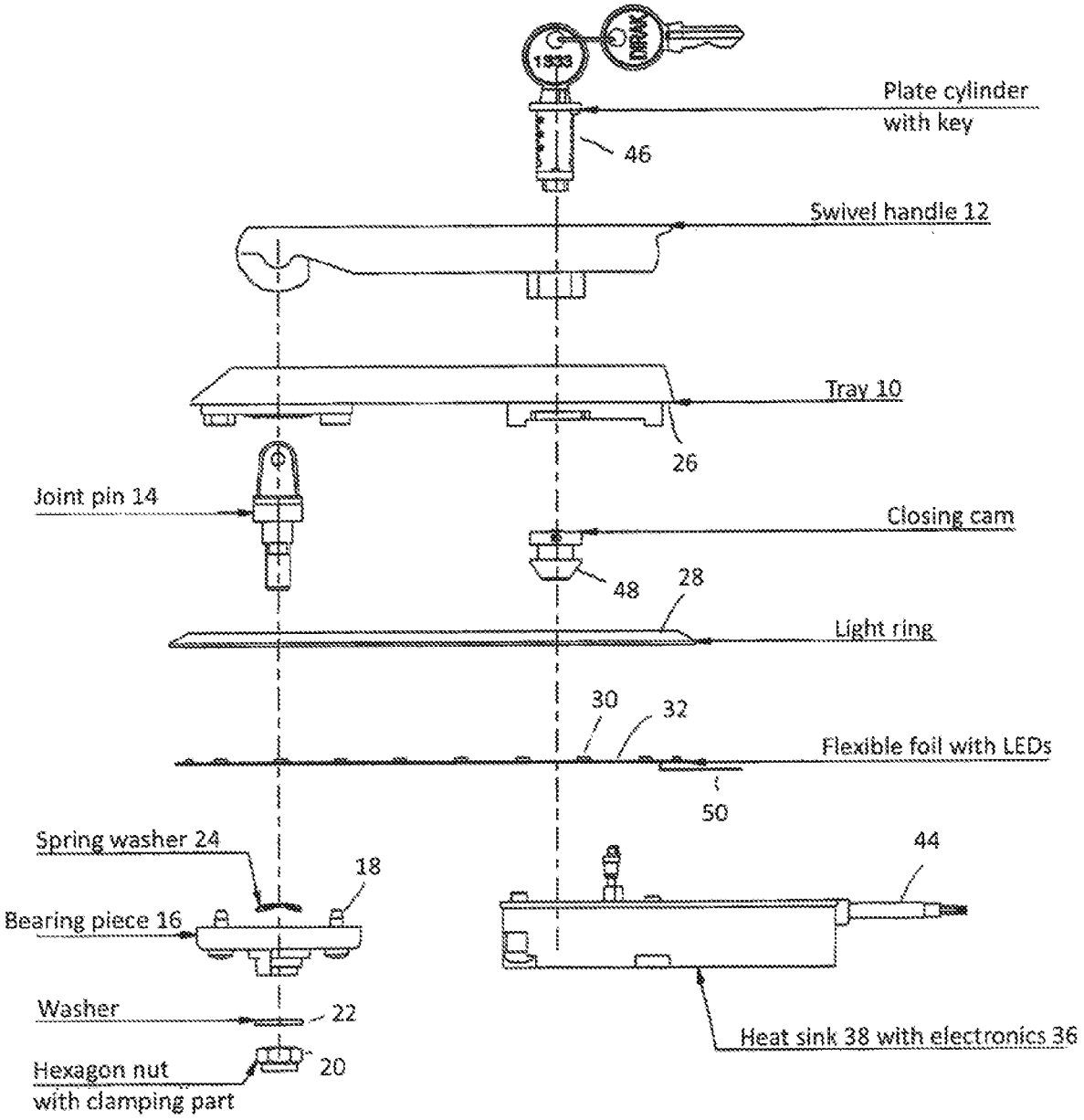
FIG. 1 shows a schematic view of an LED ring for mechatronic systems.
Figure 2:
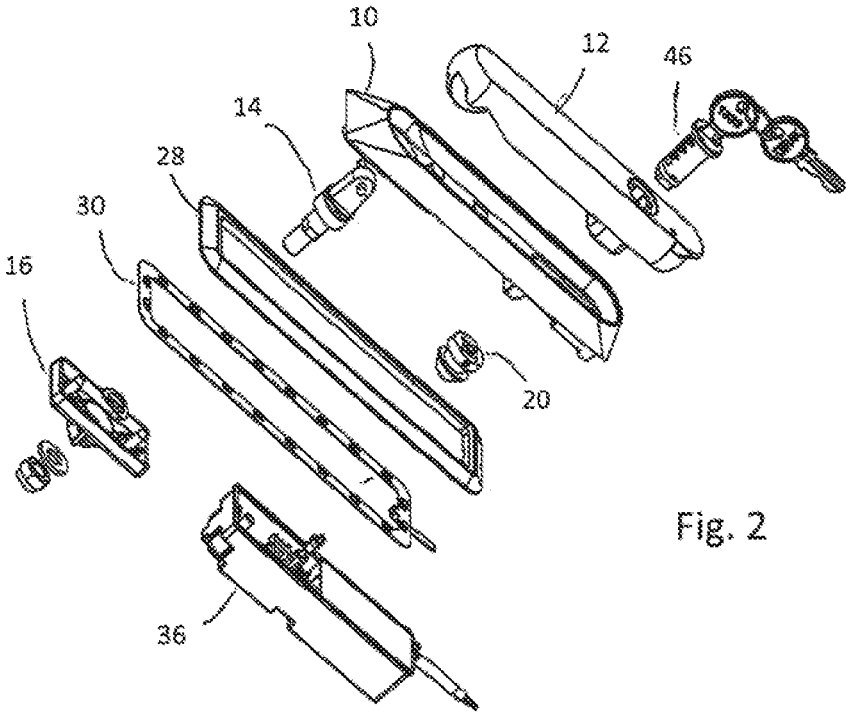
FIG. 2 shows an exploded view of the system from FIG. 1.

FIG. 1 shows a light ring 28 according to the invention comprising a LED ring for a mechatronic swivel lever system, wherein the swivel lever system comprises a closure system, further, an actuating means, namely a swivel handle 12, rotatably supported in a housing 110 or tray 10, which swivel handle 12 is articulated at a joint pin 14, which joint pin 14 is rotatably supported in the tray 10. The bearing support can also be carried out at bearing piece 16.

Figure 3:
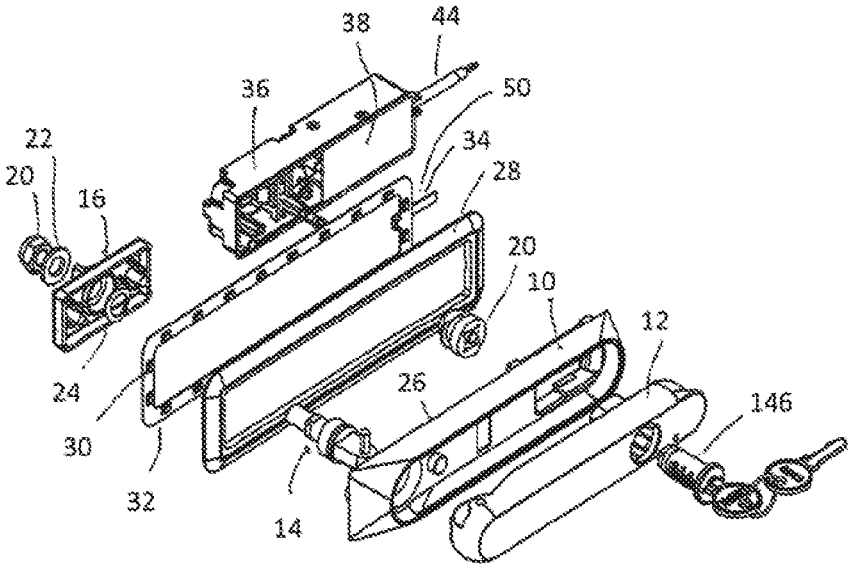
FIG. 3 shows an exploded view of the system from FIG. 1 from another angle.

The bearing piece 16 is screwed by means of screws 18 to the tray 10 with the intermediary of a thin wall 42, 142 (shown in FIGS. 4B and 9C) such as a door panel. A hexagon nut 20 with clamping part 21, washer 22 and, on the other side of the bearing piece 16, a spring washer 24 provide for a stable bearing support of the joint pin. The tray 10 forms a flange 26 by which the tray 10 secures a light ring 28. The light ring can be illuminated by LEDs 30 arranged with a flexible foil 32, see also FIG. 3. The power supply of the light emitting diodes is carried out via foil contacts or foil conductors 34. The light emissions are controlled by an electronics module 36 which comprises an integrated heat sink 38.

Figure 4A:
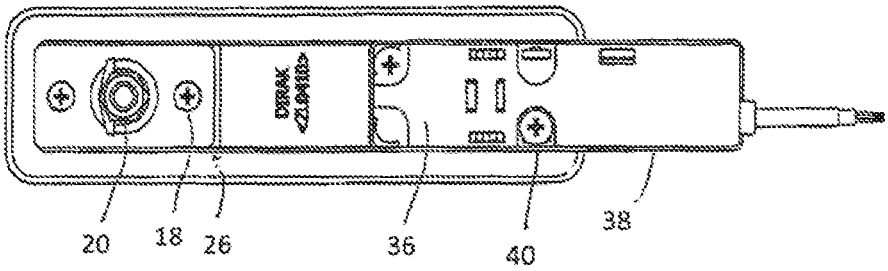
FIG. 4A shows a rear view of the system from FIG. 1.

In FIG. 4A, fastening screws 40 are provided for the electronics component 36.

Figure 4B:
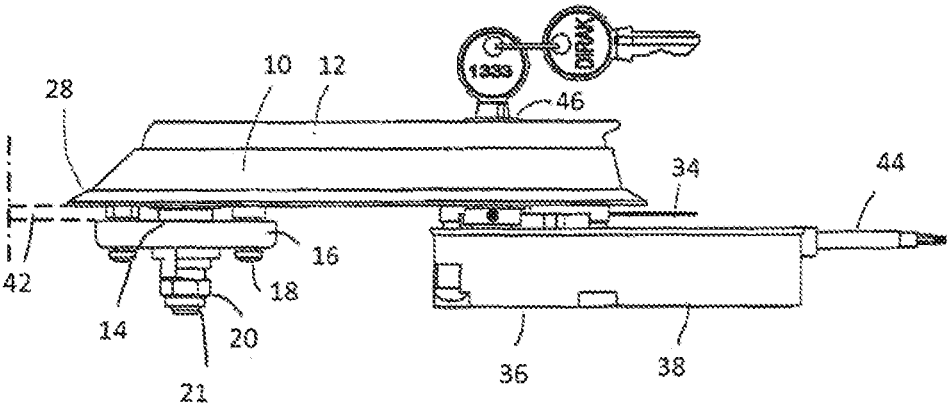
FIG. 4B shows a side view.
Figure 4C:
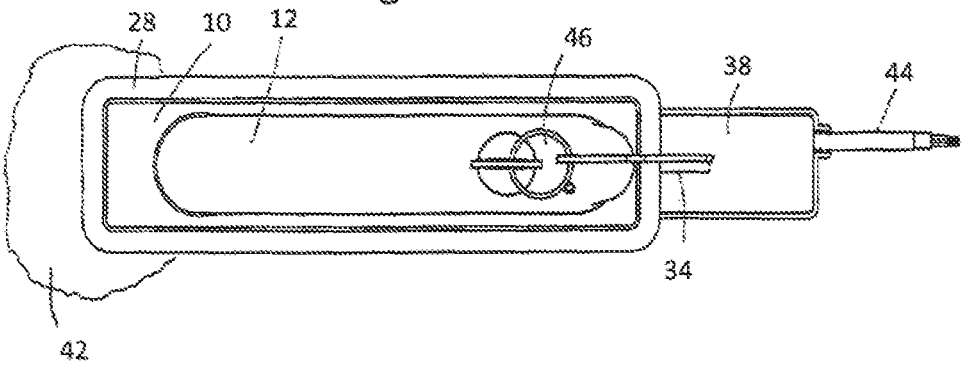
FIG. 4C shows a top view.

Thin wall 42 is shown in FIG. 4B. This thin wall 42 is clamped by the bearing piece 16 with screw 18 on one side and by the electronics part 36 by means of screws 40 between the foil and the light ring 28 on the other side of the thin wall.

With respect to the power required, this power can be supplied to the module 36 via a cable line 44. This power can originate from the electrical grid or from a battery.

The swivel handle 12 can be locked by means of a cylinder closure 46 and the closing cam 48 extends into the electronics module 36. The position of the closing cam can be sensed by the electronics module 36.

Figure 5:
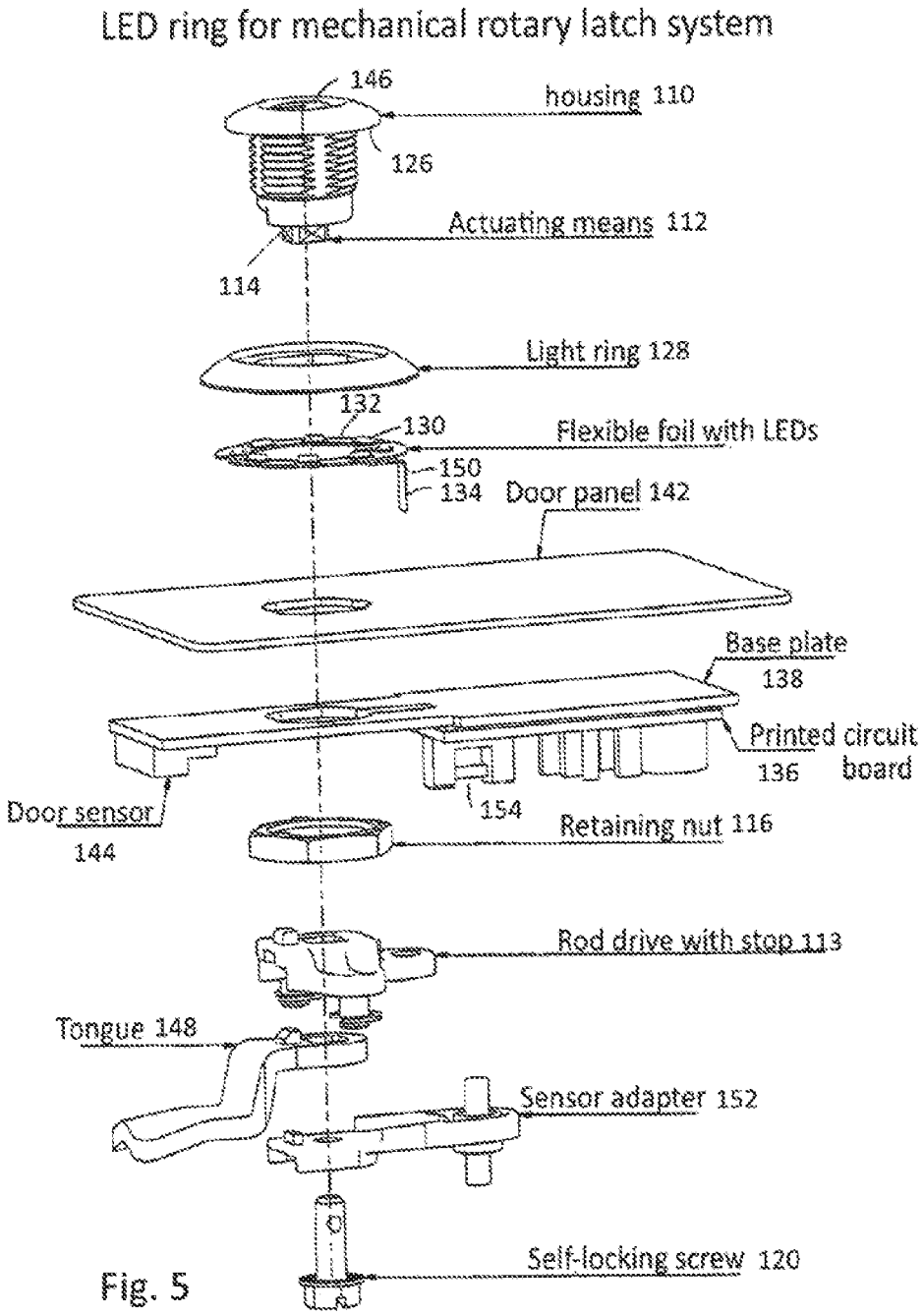
FIG. 5 shows a schematic view of a system with an LED ring for a mechanical rotary latch system.

FIG. 5 shows an LED ring for a mechanical rotary latch system. The rotary latch system comprises a housing 110 with an actuating means 112, a rod drive with stop 113, with a tongue 148 and a sensor adaptor 152. The housing 110 is held on a door panel 142. A light ring 125 which comprises a flexible foil with light emitting diodes is arranged between door panel 142 and the flange 126 of housing 110. A printed circuit board 136 which is mounted on a base plate 138 is also provided with a lead 156. The base plate 138 carries a door sensor 144 and the printed circuit board 136 carries a sensor 154 which cooperates with a sensor adaptor 152 and determines a position of the tongue 148.

Figure 8A:
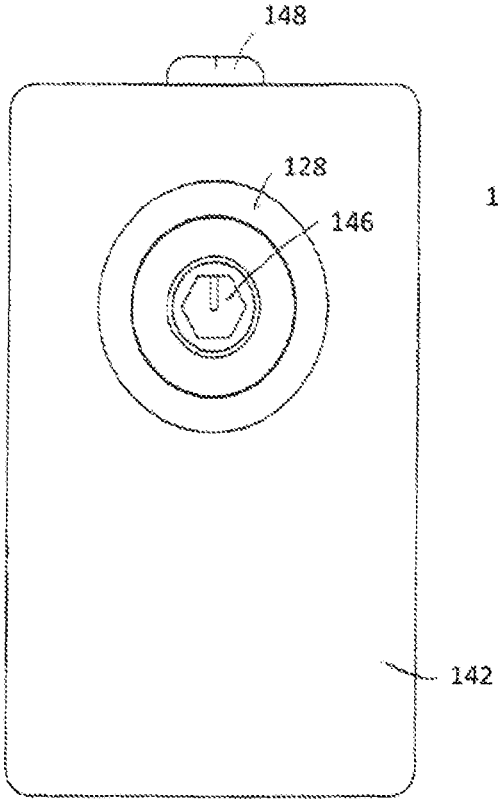
FIG. 8A shows a top view of the assembled system from FIG. 5.
Figure 8B:
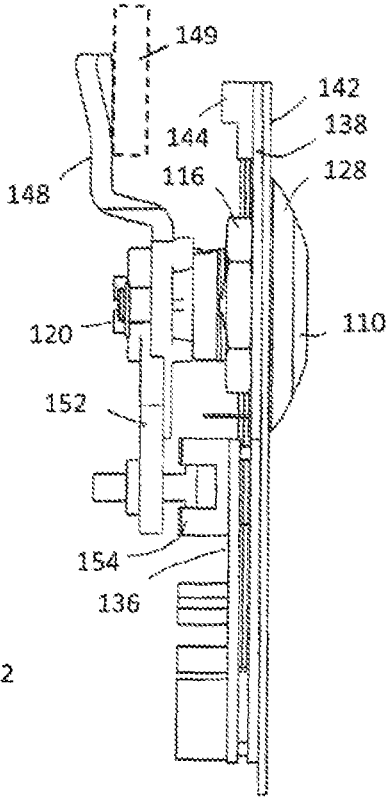
FIGS. 8B and 8C shows a view of the side wall from above the open closure.

According to FIGS. 8A, 8B, this is shown, for example, in three different arrangements in which the tongue 148 engages behind the door frame 139 and accordingly holds the door 142 shut.

Power supply 144 is provided at the door 142 between door leaf 142 and tongue 148.

Figure 6:
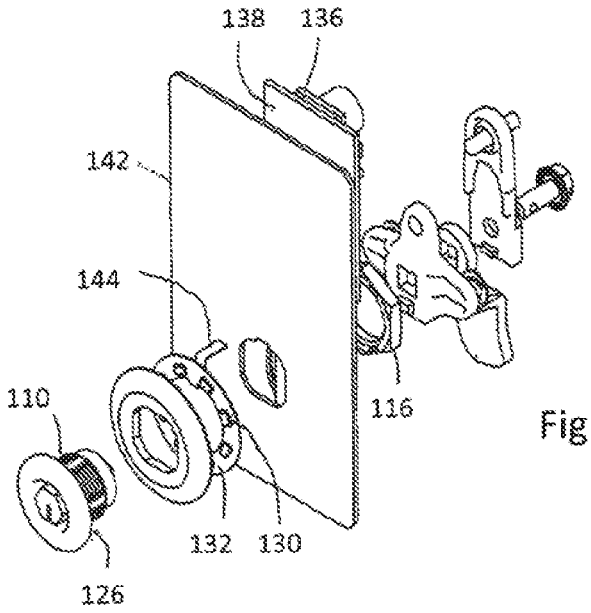
FIG. 6 shows a perspective exploded view of the LED ring at a rotational angle of observation at a first angle.
Figure 7:
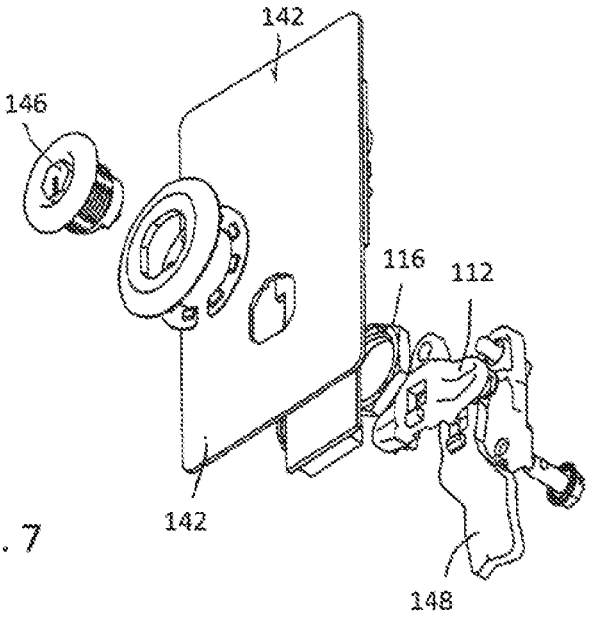
FIG. 7 shows the exploded view of the system from FIG. 6 from another angle.
Figure 8C:
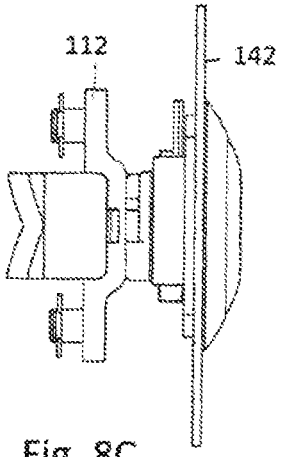

FIG. 8A shows a top view, FIG. 8B shows a side view and FIG. 8C shows a plan view from above of the embodiment form with rotary latch 118 which is also shown in FIGS. 5, 6 and 7.

Figure 9A:
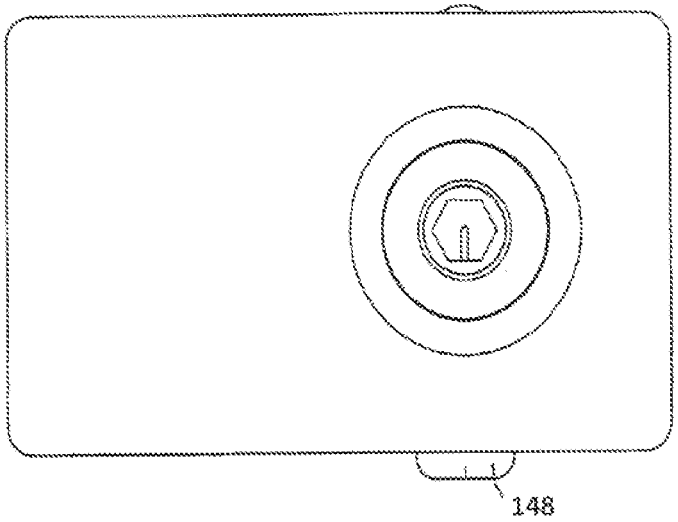
FIG. 9A shows the closed closure position of the closure from FIG. 5A or 8C.
Figure 9B:
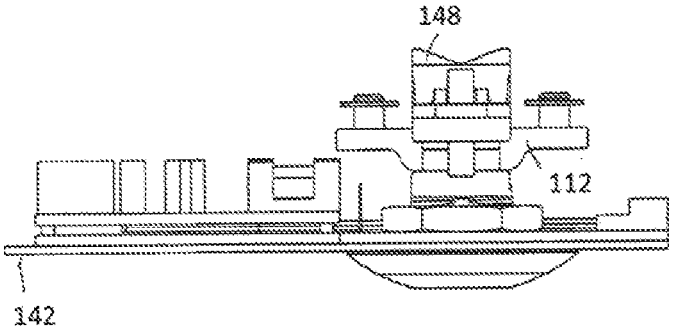
FIG. 9B shows the view from FIG. 9A from above.
Figure 9C:
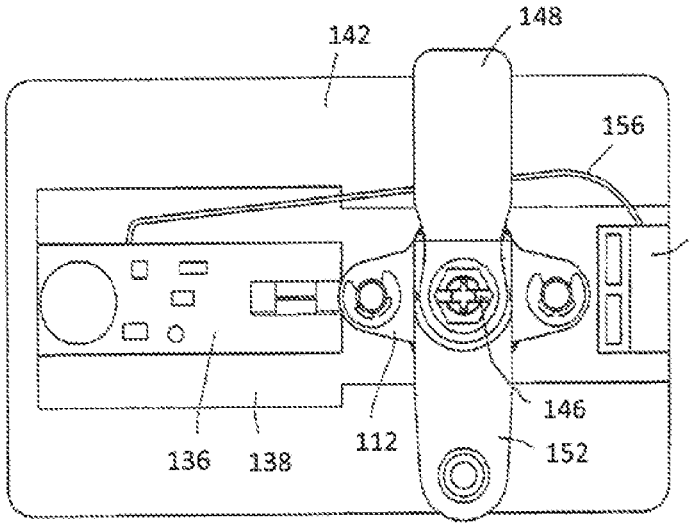
FIG. 9C shows the view from FIG. 9A from the rear.
Figure 10A:
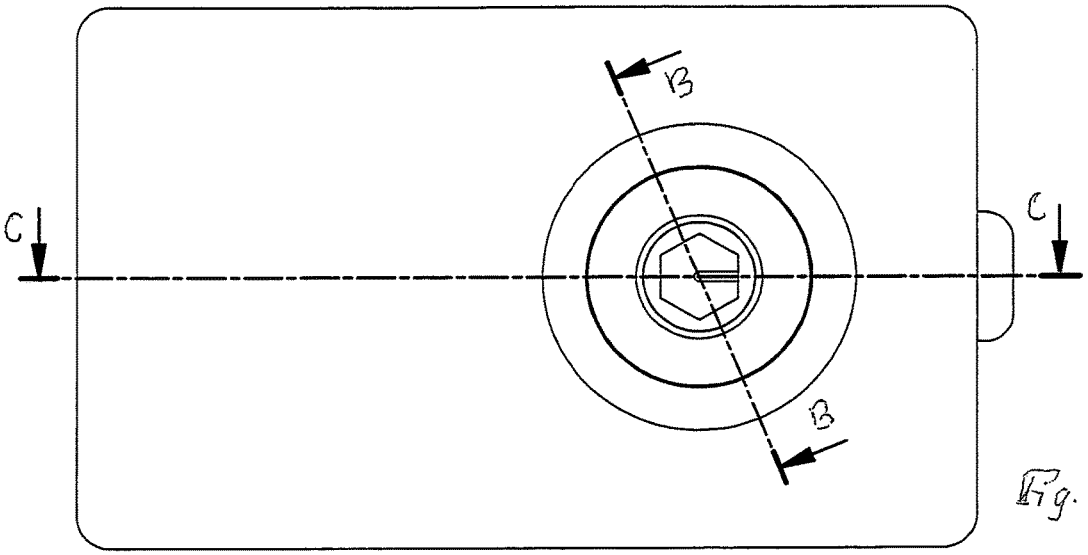
FIG. 10A shows a view as in FIG. 8A.
Figure 10B:
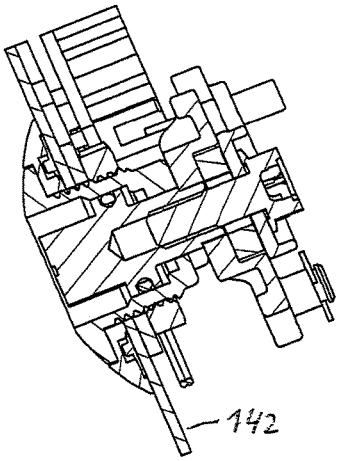
FIG. 10B shows a sectional view along line B-B from FIG. 10A.
Figure 10C:
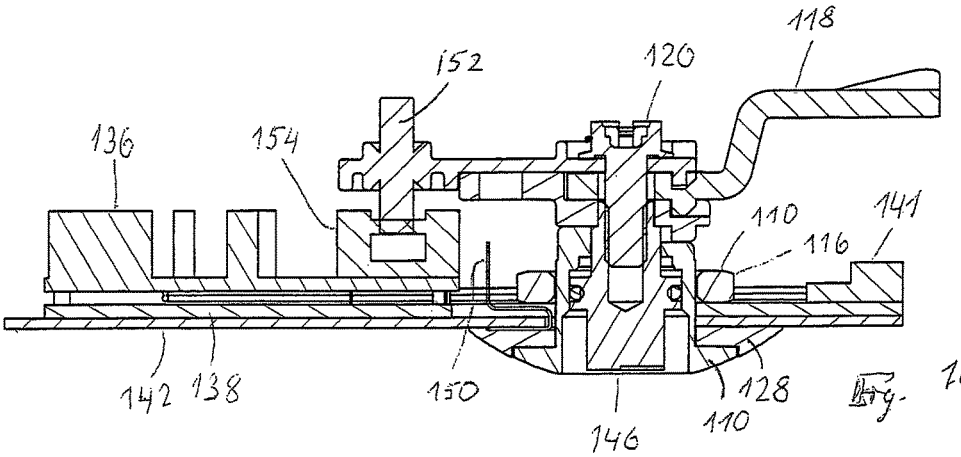
FIG. 10C shows a sectional view along line C-C from FIG. 10A.
Figure 11A:
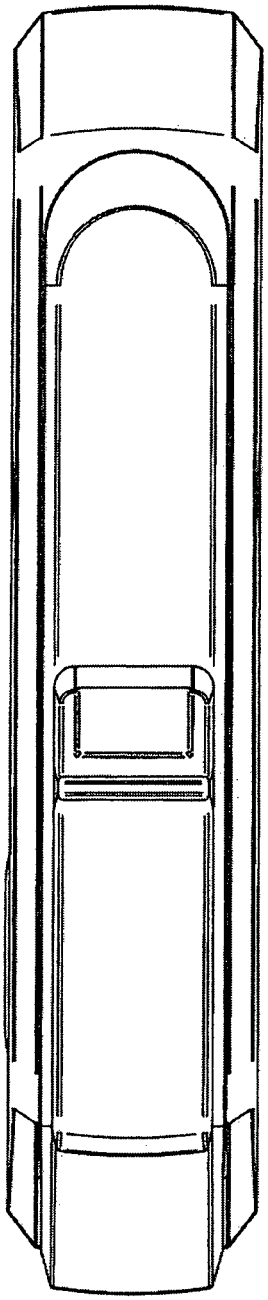
FIG. 11A shows a top view of an alternative, not according to the invention, of a mechatronic system working with light guides.
Figure 11B:
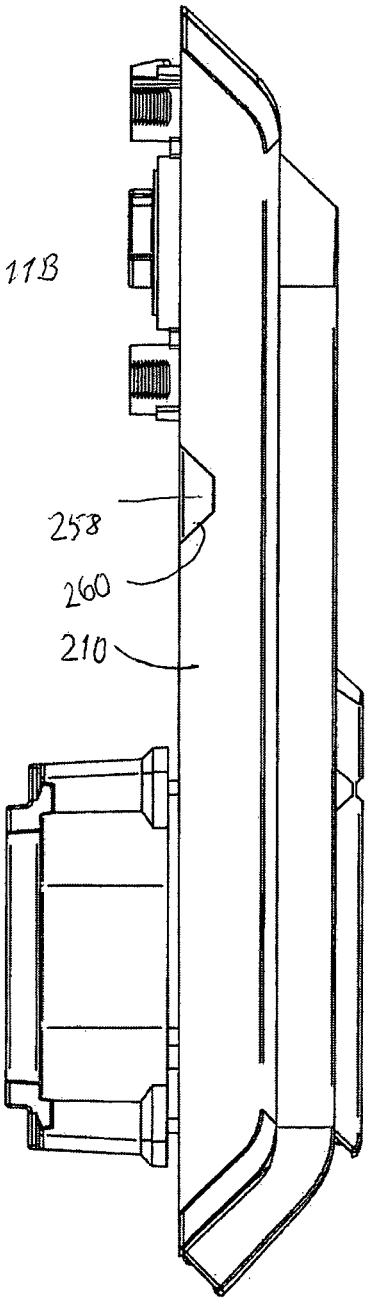
FIG. 11B shows a side view.
Figure 11C:
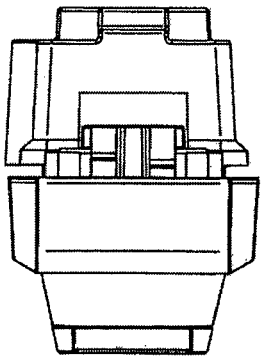
FIG. 11C shows a front view.
Figure 11D:
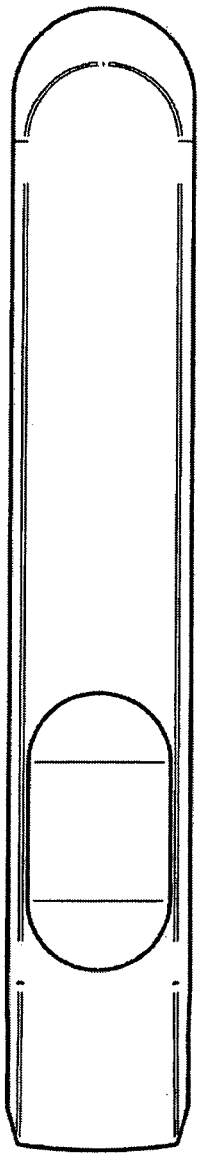
FIGS. 11D to 11F shows three top views of different actuation levers.
Figure 11E:
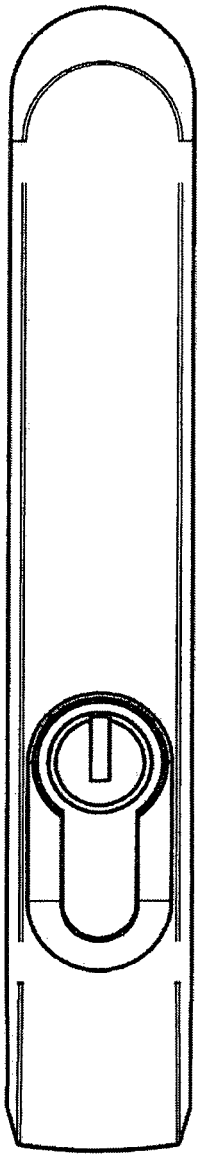
Figure 11F:
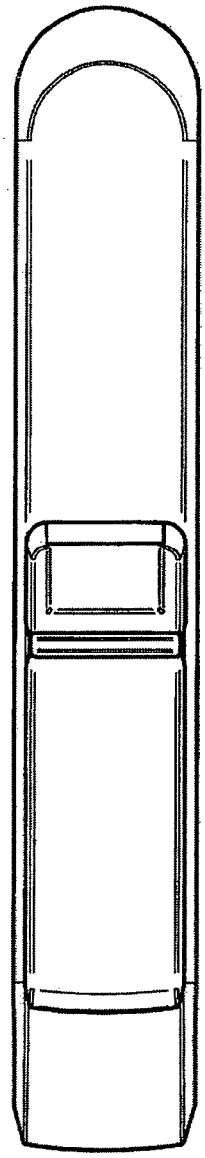
Figure 11G:
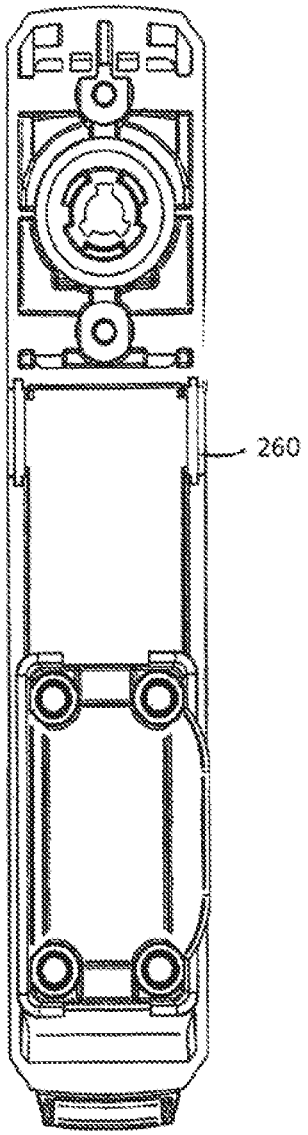
FIG. 11G shows a rear view of the swivel lever in a position in which it is folded into the tray.
Figure 11H:
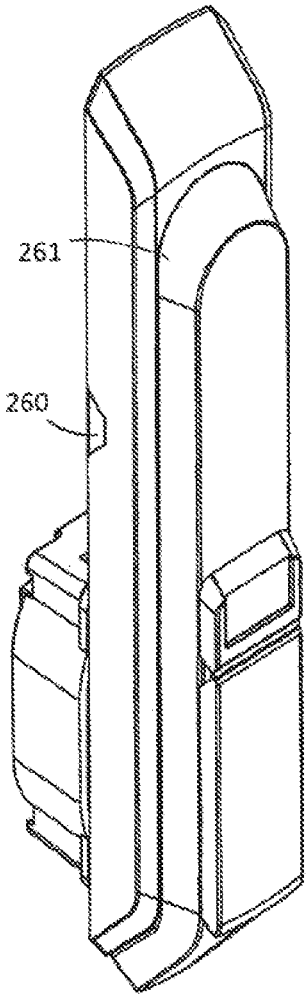
FIG. 11H shows a perspective view of the lever from FIG. 11H in folded-in position.

Further views and the manner of functioning are shown in FIGS. 9A, 9B, 9C and the sectional views in FIGS. 10B and 10C, wherein the sections are disposed according to FIG. 10A, see section lines BB and CC. Light ring 28, 128 comprises a carrier for the light emitting diodes, wherein the light ring is made of glass, plastic which is transparent and can have, e.g., PC, PMMA with diffuser compounded therein and/or can have a roughened surface, e.g., an erosion structure, and can also be outfitted with integrated optical waveguides. This material is arranged on one side and embedded in a flexible foil 132 and provided with connections which are guided out of the flexible material and can be connected to a power source such that current flows through the LEDs.

FIG. 10C schematically shows the flexible foil 132, the manner in which the latter is secured by the flange 14 of the housing and forms a current-free transition surface. The light emitting diodes are arranged as individual piece or as a plurality in series or as group. The LEDs can be red, yellow or monochromatic of one color or can also emit different colors at different voltages. The layout can be carried out in a free-form manner or can be adapted to the contour of the system. The flexible foil or flexible film has the advantage that it can be adapted easily to different contours of the actuating means, for example, to the round housing shape of the embodiment form according to FIGS. 5 to 10, for example, or also to the rectangular housing shape of the embodiment form according to FIGS. 1 to 4.

Other similar materials can also be used for the printed circuit board, e.g., CM1, CM3, FR2, FR3, FR4, FR5, FR5BT, polyamide, Teflon (PTFE), or ceramic. The electronics module 136 for detecting the state of the door can comprise a reed sensor, a Hall sensor, a reflection-type photo-switch, a light barrier, mechanical feeler, pressure sensors, light sensors, proximity sensors which can operate inductively, capacitively or by ultrasound, temperature sensors, or rotational angle sensors. The placement of the sensor can be carried out by the customer (in case of an existing sensor) or on the door frame, on the hinge, provided for a minimum quantity of a sensor in the system and at least one externally switchable sensor.

Sensors can also be provided for detecting the actual state of the lock 146, for example, a fork light barrier, a light barrier, a reflection-type photo-switch, a mechanical feeler, a pressure sensor, a potentiometer, a proximity sensor which can operate inductively, capacitively or by ultrasound, a rotational angle sensor, a reed sensor, and a Hall sensor.

The sensor placement for detecting the closing state, i.e., the position of the rotary latch 148, can be carried out by an extension or an adaptor 152 outside of the rotary latch, for example, with the arrangement of the extension according to reference numeral 152,154 or also integrated in the rotary latch.

Depending on external factors, a network device or battery operation can be provided for power supply, see power cable 156 in FIG. 9C, 144 in FIGS. 1, 4A to 4C. The invention according to the arrangement is connected in a network-ready manner via cable or wirelessly to other systems. An interface for external program units is possible. The switching elements are advisably protected by a cover cap. The system according to the invention with an LED ring can be configured as rotary latch closure, swivel lever closure, compression closure, latch closure, snap closure, bar closure or as recessed handle. To this extent, the embodiment forms shown only represent examples which are particularly favorable.

In an alternative not according to the invention, a light guide 258 is part of the wall of the tray 210 and is made of a translucent plastic and arranged and shaped in such a way that the wall 260 is illuminated at the desired location during operation of the light emitting diode 262. The light guide 258 can be removed as part of the wall 260 and may be replaced by a part of another color.

Two parts 260 of this kind can be provided and connected by a carrier plate 264. The carrier plate 264 can also form a receptacle for a button cell 266.

According to another further development, the light guide can be characterized in that a light emitting diode 262 is arranged in the vicinity of the shaft on the underside of the tray and has light contact with parts of the wall 268 of the tray 210.

On the other hand, the light guide can be characterized in that a light emitting diode 262 is arranged in the vicinity of the shaft 214 and has light contact with the wall 261 of the hand lever 214.

INDUSTRIAL APPLICABILITY

The invention is commercially applicable in a switch cabinet construction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

LIST OF REFERENCE NUMERALS

10, 110, 210 tray, housing
12, 112 swivel handle, actuating means, rod drive with stop
13 rod drive
14, 114, 214 joint pin, actuating means, shaft
16, 116 bearing piece, retaining nut
18 screw
20, 120 hexagon nut with clamping part, self-locking screw
21 clamping part
22 washer
24 spring washer
26, 126 flange
28, 128 light ring
30, 130 LED
32, 132 flexible foil
34, 134 foil conductor
36, 136 electronics module, printed circuit board
38,138 heat sink, base plate
139 door frame
40 fastening screws
42, 142 thin wall
44, 144 power supply electronics
46, 146 cylinder closure
48, 148 closing cam, tongue
50, 150 power supply LED
152 sensor adaptor
154 closing sensor
156 cable connection
258 light guide
260 wall
261 wall
262 light emitting diode
264 carrier plate
266 button cell
268 wall

The invention claimed is:

1. A mechanical or mechatronic closure system comprising: a housing or tray; an actuating means configured to be rotatably supported in the housing or tray; a retaining nut or bearing piece configured to be screwed on to the housing or to the tray with a thin wall being arranged therebetween; a light ring configured to surround a flange of the housing or of the tray; and a flexible foil configured to be arranged between the light ring and thin wall, the flexible foil carrying light emitting diodes (LEDs) and relaying light of the LEDs.

2. The mechanical or mechatronic closure system according to claim 1, further comprising:

an electronics module, or a base plate with a printed circuit board;

wherein the electronics module or base plate is configured to be screwed to the tray or to the housing with the flexible foil and LEDs being arranged therebetween.

3. The mechanical or mechatronic closure system according to claim 2;

wherein the mechanical or mechatronic closure system further comprises the electronics module; and wherein the electronics module has an integrated heat sink.

4. The mechanical or mechatronic closure system according to claim 2;

wherein the mechanical or mechatronic closure system further comprises the base plate; and wherein the base plate supports a contact sensor that cooperates with a sensor adaptor configured to be moved by a movement of a latch.

5. The mechanical or mechatronic closure system according to claim 2;

wherein the mechanical or mechatronic closure system further comprises the base plate; and wherein the base plate has at least part of a door sensor at one longitudinal end for determining the presence of a door frame.

6. The mechanical or mechatronic closure system according to claim 5;

wherein the base plate supports a contact sensor that cooperates with a sensor adaptor configured to be moved by a movement of a latch; and wherein the contact sensor is part of the printed circuit board.

7. The mechanical or mechatronic closure system according to claim 1;

wherein the LED ring is made of glass or transparent plastic, optionally with integrated optical waveguides.

8. The mechanical or mechatronic closure system according to claim 5;

wherein the door sensor comprises a second part that is a reed sensor, Hall sensor, reflection photo-switch, light barrier, mechanical feeler, pressure sensor, light sensor, proximity sensor, temperature sensor, or rotational angle sensor; and wherein the second part of the door sensor is configured to be placed by a customer on the door frame.

9. The mechanical or mechatronic closure system according to claim 1, further comprising:

a closing sensor configured to detect a closing state of the closure system, the closing sensor comprising:

a fork light barrier, light barrier, reflection photo-switch, mechanical feeler, pressure sensor, potentiometer, proximity sensor, rotational angle sensor, reed sensor, Hall sensor or combination thereof.

10. The mechanical or mechatronic closure system according to claim 1;

wherein the mechanical or mechatronic closure system comprises the tray; and wherein the tray has a tray wall, and a first part of the tray wall comprises a translucent plastic and is arranged and shaped in such a way that the tray wall lights up at a first desired location during operation of the light emitting diode.

11. The mechanical or mechatronic closure system according to claim 10; wherein the first part of the tray wall is removable and is configured to be replaced by a part of a different color.

12. The mechanical or mechatronic closure system according to claim 11;

wherein a second part of the tray wall comprises a translucent plastic and is arranged and shaped in such a way that the tray wall lights up at a second desired location during operation of the light emitting diode; and wherein the second part of the tray wall is connected to the first part of the tray wall by a carrier plate.

13. The mechanical or mechatronic closure system according to claim 12;

wherein the carrier plate also forms a receptacle for a button cell battery.

14. The mechanical or mechatronic closure system according to claim 1;

wherein the mechanical or mechatronic closure system comprises the tray; and wherein a light emitting diode is arranged in a vicinity of a shaft on an underside of the tray and has light contact with parts of a wall of the tray.

15. The mechanical or mechatronic closure system according to claim 1;

wherein the mechanical or mechatronic closure system comprises the tray; and wherein a light emitting diode is arranged in a vicinity of a shaft and has light contact with a wall of a hand lever.

16. The mechanical or mechatronic closure system according to claim 9, further comprising:

a rotary latch;

wherein the closing sensor separate from the rotary latch, with the closing sensor being configured to be linked to the rotary latch.

17. The mechanical or mechatronic closure system according to claim 9, further comprising:

a rotary latch;

wherein the closing sensor is integrated in the rotary latch.

* * * * *